US010879618B2

(12) United States Patent
Mazaheri Kalahrudi et al.

(10) Patent No.: US 10,879,618 B2
(45) Date of Patent: Dec. 29, 2020

(54) WIDEBAND SUBSTRATE INTEGRATED WAVEGUIDE SLOT ANTENNA

(71) Applicants: Mohammad Hossein Mazaheri Kalahrudi, Tehran (IR); Amir Jafargholi, Tehran (IR); Jalaledin Tayebpour, Tehran (IR); Alireza Jahanbakhshi, Tehran (IR); Mahmood Akbari, Tehran (IR)

(72) Inventors: Mohammad Hossein Mazaheri Kalahrudi, Tehran (IR); Amir Jafargholi, Tehran (IR); Jalaledin Tayebpour, Tehran (IR); Alireza Jahanbakhshi, Tehran (IR); Mahmood Akbari, Tehran (IR)

( * ) Notice: Subject to any disclaimer, the term of this patent is extended or adjusted under 35 U.S.C. 154(b) by 15 days.

(21) Appl. No.: 16/280,742

(22) Filed: Feb. 20, 2019

(65) Prior Publication Data

US 2019/0181559 A1 Jun. 13, 2019

Related U.S. Application Data

(60) Provisional application No. 62/633,082, filed on Feb. 21, 2018.

(51) Int. Cl.
*H01Q 13/10* (2006.01)
*H01Q 1/38* (2006.01)
(Continued)

(52) U.S. Cl.
CPC ..... *H01Q 13/28* (2013.01); *H01Q 1/38* (2013.01); *H01Q 5/335* (2015.01); *H01Q 13/10* (2013.01);
(Continued)

(58) Field of Classification Search
CPC ..... H01Q 13/28; H01Q 5/335; H01Q 13/18; H01Q 21/0087; H01Q 21/0062;
(Continued)

(56) References Cited

U.S. PATENT DOCUMENTS 4,291,312 A * 9/1981 Kaloi ..... H01Q 1/48 343/700 MS
4,692,769 A * 9/1987 Gegan ..... H01Q 9/0407 343/700 MS
(Continued)

OTHER PUBLICATIONS

Amir Jafargholi et al., "Broadband microstrip antenna using epsilon near zero metamaterials", IET 2015, pp. 1-6 (Year: 2015).*

*Primary Examiner* — Vibol Tan
(74) *Attorney, Agent, or Firm* — Bajwa IP Law Firm; Haris Zaheer Bajwa

(57) ABSTRACT

A substrate integrated waveguide (SIW) slot antenna may include a substrate that may have a first substrate portion with a first permittivity less than unity and a second substrate portion with a second permittivity. The substrate may include a top surface and a bottom surface. The exemplary SIW slot antenna may further include a first conductive layer disposed on the top surface, a second conductive layer disposed on the bottom surface, a transverse slot on the first conducting layer, waveguide sidewalls that may include a plurality of spaced-apart metal-lined vias traversing the substrate, and a microstrip feed line on the first conducting layer.

12 Claims, 14 Drawing Sheets

(51) Int. Cl.

| | |
|---|---|
| ***H01Q 13/28*** | (2006.01) |
| ***H01Q 21/00*** | (2006.01) |
| ***H01Q 5/335*** | (2015.01) |
| ***H01Q 13/18*** | (2006.01) |

(52) U.S. Cl.
CPC ..... *H01Q 13/18* (2013.01); *H01Q 21/0062* (2013.01); *H01Q 21/0087* (2013.01)

(58) Field of Classification Search
CPC ..... H01Q 1/38; H01Q 9/0407; H01Q 13/10; H01Q 13/106; H01Q 21/065; H01Q 21/0075; H01Q 9/0421; H01Q 9/065; H01Q 9/0457; H01Q 9/285; H01Q 13/085; H01Q 21/005; H01Q 5/357
See application file for complete search history.

(56) References Cited

U.S. PATENT DOCUMENTS

| | | | | |
|---|---|---|---|---|
| 6,720,926 | B2 * | 4/2004 | Killen | H01Q 1/38 343/700 MS |
| 6,842,140 | B2 * | 1/2005 | Killen | H01Q 1/38 343/700 MS |
| 6,975,276 | B2 * | 12/2005 | Brown | H01Q 3/46 343/767 |
| 8,669,834 | B2 * | 3/2014 | Cheng | H01P 3/121 29/600 |
| 9,088,060 | B2 * | 7/2015 | Robin | H01P 5/107 |
| 9,715,953 | B2 * | 7/2017 | Weldon | H01Q 15/0086 |
| 10,103,445 | B1 * | 10/2018 | Gregoire | H01Q 13/103 |
| 10,431,895 | B2 * | 10/2019 | Chung | H01Q 21/005 |

* cited by examiner

WIDEBAND SUBSTRATE INTEGRATED WAVEGUIDE SLOT ANTENNA

CROSS-REFERENCE TO RELATED APPLICATIONS

This application claims the benefit of priority from U.S. Provisional Patent Application Ser. No. 62/633,082, filed on Feb. 21, 2018, and entitled "SIW SLOT ANTENNA WITH METAMATERIAL SUBSTRATE," which is incorporated herein by reference in its entirety.

TECHNICAL FIELD

The present disclosure relates to radio wireless communication systems, particularly relates to printed slot antennas, and more particularly, relates to a substrate integrated waveguide slot antenna with a metamaterial substrate.

BACKGROUND

Utilizing substrate integrated waveguide (SIW) technology in slot antennas allows for fabricating slot antennas that may function as a low profile planar antenna in compact and integrated wireless communication systems. In comparison with microstrip antennas, SIW slot antennas exhibit a smaller amount of unwanted radiation from walls of the waveguide. Moreover, an SIW structure is compatible with printed circuits, which allows for integrating the SIW structure with micro-strip devices and components.

SIW slot antennas may be fabricated with a low production cost and may be utilized in millimeter waveband to provide sufficient gain. However, antenna efficiency and bandwidth of SIW slot antennas are limited due to their resonance characteristics. One way to address the limited bandwidth of slot antennas may be utilizing multiple slots with close resonance frequencies. However, this technique requires a considerable number of longitudinal slots, which undesirably increases the antenna size. Another way to address the limited bandwidth may be simultaneously exciting to hybrid modes in an SIW cavity. A multi-mode resonance SIW cavity may be utilized along with a complementary split ring resonator. The inherent multimode resonance of the split ring resonator along with SIW cavity resonance may provide a high bandwidth, but at the expense of undesirably increasing cross polarization in the H-plane, specifically at higher frequencies. There is a need for methods that may be utilized for improving the bandwidth of slot antennas without affecting the antenna size or polarization.

SUMMARY

This summary is intended to provide an overview of the subject matter of the present disclosure and is not intended to identify essential elements or key elements of the subject matter, nor is it intended to be used to determine the scope of the claimed implementations. The proper scope of the present disclosure may be ascertained from the claims set forth below in view of the detailed description below and the drawings.

According to one or more exemplary embodiments, the present disclosure is directed to a substrate integrated waveguide (SIW) slot antenna. The exemplary wideband SIW antenna may include a substrate that may have a first substrate portion with a first permittivity and a second substrate portion with a second permittivity. The substrate may include a top surface and a bottom surface. The exemplary SIW slot antenna may further include a first conductive layer disposed on the top surface, a second conductive layer disposed on the bottom surface, a transverse slot on the first conducting layer, waveguide sidewalls that may include a plurality of spaced-apart metal-lined vias traversing the substrate, and a microstrip feed line on the first conducting layer. In an exemplary embodiment, the second permittivity may be less than unity.

In an exemplary embodiment, the second substrate portion may be disposed underneath the transverse slot and may be spaced apart from the waveguide sidewalls and the microstrip feed line. In an exemplary embodiment, the second substrate portion may include an epsilon-near-zero metamaterial.

In an exemplary embodiment, the first substrate portion and the second substrate portion may include a dielectric material and the second substrate portion may further include a first array of conductive wires disposed along and spaced apart from a first side of the transverse slot. Each wire in the first array of conductive wires may be inserted into the dielectric material perpendicular to a plane of the transverse slot. The first array of conductive wires may be configured to connect the first conductive layer and the second conductive layer. The second substrate portion may further include a second array of conductive wires that may be disposed along and spaced apart from an opposing second side of the transverse slot. Each wire in the second array of conductive wires may be inserted into the dielectric material perpendicular to a plane of the transverse slot. The second array of conductive wires may be configured to connect the first conductive layer and the second conductive layer.

According to one or more exemplary embodiments, the present disclosure is further directed to a method for fabricating a wideband SIW slot antenna. The exemplary method may include forming an SIW structure by plating a first surface of a dielectric substrate with a first conductive layer, plating a second surface of a dielectric substrate with a second conductive layer, and forming waveguide sidewalls by forming a plurality of spaced-apart metal-lined vias, where each metal-lined via may include a cylindrical hole through the first conductive layer, the dielectric substrate, and the second conductive layer. Each metal-lined via may be perpendicular to planes of the first conductive layer and the second conductive layer. The exemplary method may further include forming a transverse radiating slot on the SIW structure, where the transverse radiating slot may be disposed on the first conductive layer, forming an ENZ metamaterial segment within the dielectric substrate beneath the transverse radiating slot by inserting arrays of conductive wires into the dielectric substrate on either sides of the transverse radiating slot, and forming a microstrip feed line on the first conductive layer.

In an exemplary embodiment, forming an ENZ metamaterial segment within the dielectric substrate beneath the transverse radiating slot may include inserting arrays of conductive wires into the dielectric substrate on either sides of the transverse radiating slot. Each conductive wire may be perpendicular to planes of the first conductive layer and the second conductive layer, and each conductive wire may traverse through the dielectric substrate connecting the first conductive layer and the second conductive layer.

In an exemplary embodiment, forming a transverse radiating slot on the SIW structure may include forming a rectangular transverse radiating slot on the first conductive layer. The rectangular transverse radiating slot may be symmetrically disposed in a center of the SIW structure.

In an exemplary embodiment, forming an ENZ metamaterial segment within the dielectric substrate beneath the transverse radiating slot may include inserting arrays of conductive wires into the dielectric substrate along a length of the transverse radiating slot on either opposing sides of the transverse radiating slot.

In an exemplary embodiment, forming an ENZ metamaterial segment within the dielectric substrate beneath the transverse radiating slot may include inserting arrays of conductive wires into the dielectric substrate along a length of the transverse radiating slot on either opposing sides of the transverse radiating slot. The arrays of conductive wires spaced apart from the waveguide sidewalls and the microstrip feed line.

In an exemplary embodiment, forming the microstrip feed line on the first conductive layer may include etching the microstrip feed line on the first conductive layer. The microstrip feed line may be matched with the SIW structure by a tapered transition.

According to one or more exemplary embodiments, the present disclosure is further directed to a method for increasing a bandwidth of a slot antenna with a waveguide and a radiating slot disposed on a broad surface of the waveguide. The exemplary method may include loading the waveguide with an ENZ metamaterial substrate immediately beneath the slot, the ENZ metamaterial substrate spaced-apart from waveguide sidewalls.

In an exemplary embodiment, the waveguide may include an SIW structure, where loading the waveguide with an ENZ metamaterial substrate may include loading the SIW structure with a substrate comprising at least one segment immediately beneath the radiating slot, the at least one segment comprising the ENZ metamaterial.

In an exemplary embodiment, the waveguide may include an SIW structure and the radiating slot may include a rectangular transverse radiating slot. Loading the waveguide with an ENZ metamaterial substrate may include loading the SIW structure with a dielectric substrate, and inserting arrays of conductive wires into the dielectric substrate on either sides of the radiating slot, where arrays of conductive inserted along a length of the transverse radiating slot perpendicular to a plane of the broad surface of the waveguide.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

Figure 1A:
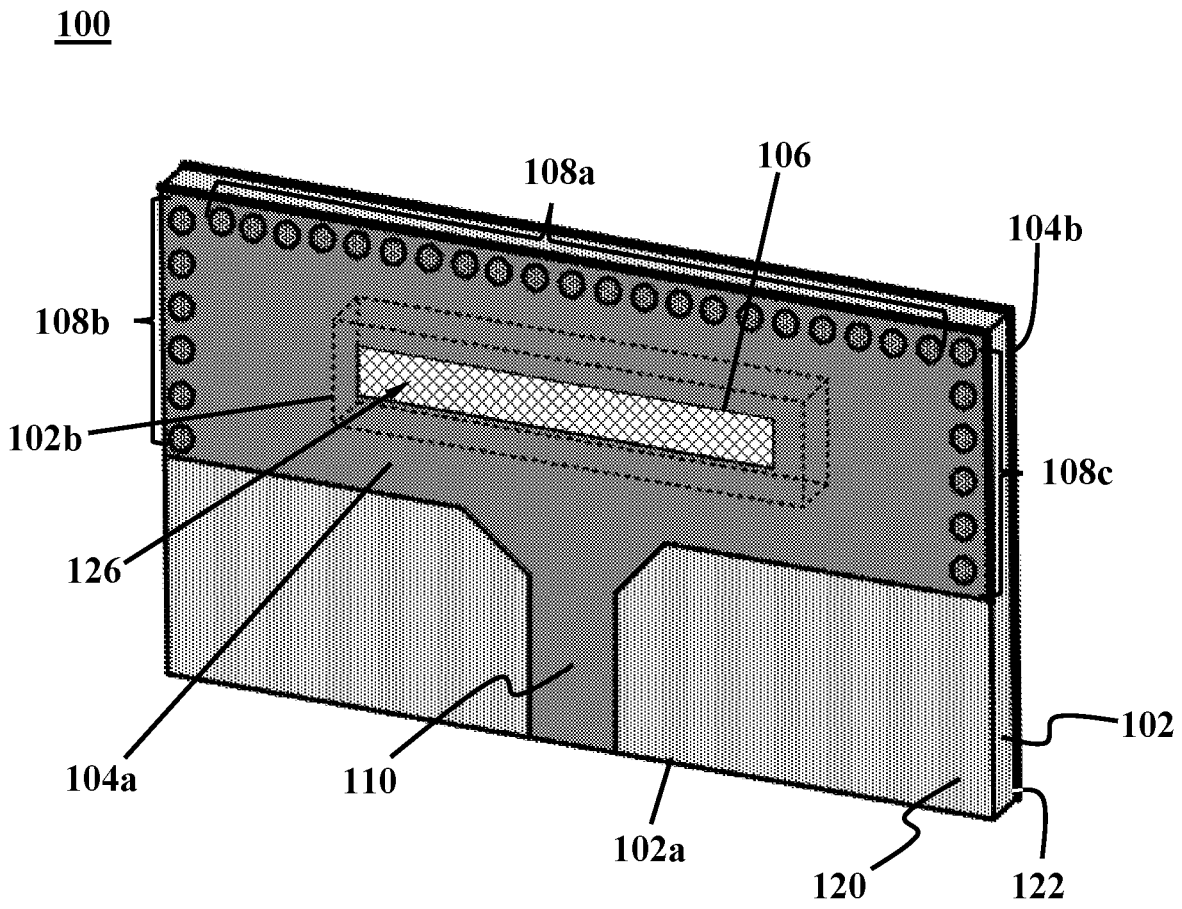
FIG. 1A illustrates a schematic perspective view of a wideband SIW slot antenna, consistent with one or more exemplary embodiments of the present disclosure.

In the following detailed description, numerous specific details are set forth by way of examples to provide a thorough understanding of the relevant teachings related to the exemplary embodiments. However, it should be apparent that the present teachings may be practiced without such details. In other instances, well known methods, procedures, components, and/or circuitry have been described at a relatively high-level, without detail, in order to avoid unnecessarily obscuring aspects of the present teachings.

The following detailed description is presented to enable a person skilled in the art to make and use the methods and devices disclosed in exemplary embodiments of the present disclosure. For purposes of explanation, specific nomenclature is set forth to provide a thorough understanding of the present disclosure. However, it will be apparent to one skilled in the art that these specific details are not required to practice the disclosed exemplary embodiments. Descriptions of specific exemplary embodiments are provided only as representative examples. Various modifications to the exemplary implementations will be plain to one skilled in the art, and the general principles defined herein may be applied to other implementations and applications without departing from the scope of the present disclosure. The present disclosure is not intended to be limited to the implementations shown, but is to be accorded the widest possible scope consistent with the principles and features disclosed herein.

The present disclosure is directed to exemplary methods for fabricating resonant-type slot antennas with improved impedance bandwidth and exemplary methods for increasing an impedance bandwidth of a resonant-type slot antenna by loading the slot antenna with an epsilon-near-zero (ENZ) metamaterial. In exemplary methods, an ENZ metamaterial that exhibits a near-zero permittivity may be used as a dielectric substrate in the structure of exemplary slot antennas in order to increase impedance bandwidths of the exemplary slot antennas.

The present disclosure is further directed to an exemplary wideband substrate integrated waveguide (SIW) slot antenna. An exemplary wideband SIW slot antenna may include an SIW structure and a transverse radiating slot that may be disposed on the SIW structure. The SIW structure may include a dielectric substrate that may be plated at either broad surfaces by a first conductive layer and a second conductive layer and waveguide sidewalls that may be made of arrays of spaced-apart metal-lined vias traversing through the substrate connecting the first conductive layer and the second conductive layer. The SIW structure may be fed by a microstrip feed line. In exemplary embodiments, the exemplary dielectric substrate may have two portions, namely, a first substrate portion with a first permittivity and a second substrate portion with a second permittivity less than unity. In an exemplary embodiments, the second substrate portion may be placed immediately beneath the transverse radiating slot away from the waveguide sidewalls. The second substrate portion may include a homogeneous ENZ metamaterial. In exemplary embodiments, utilizing a homogeneous ENZ metamaterial in the SIW structure of the exemplary SIW slot antenna may allow for significantly increasing the impedance bandwidth of the exemplary SIW slot antenna.

Figure 1B:
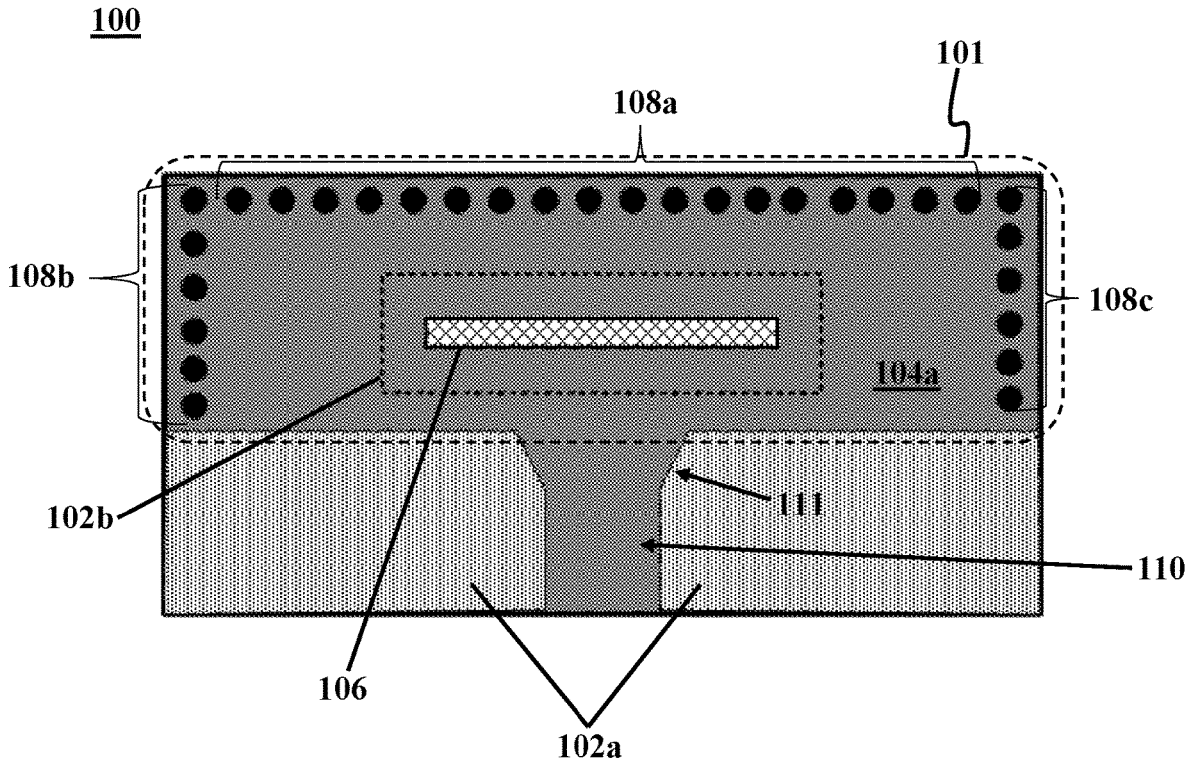
FIG. 1B illustrates a schematic front view of a wideband SIW slot antenna, consistent with one or more exemplary embodiments of the present disclosure.
Figure 1C:
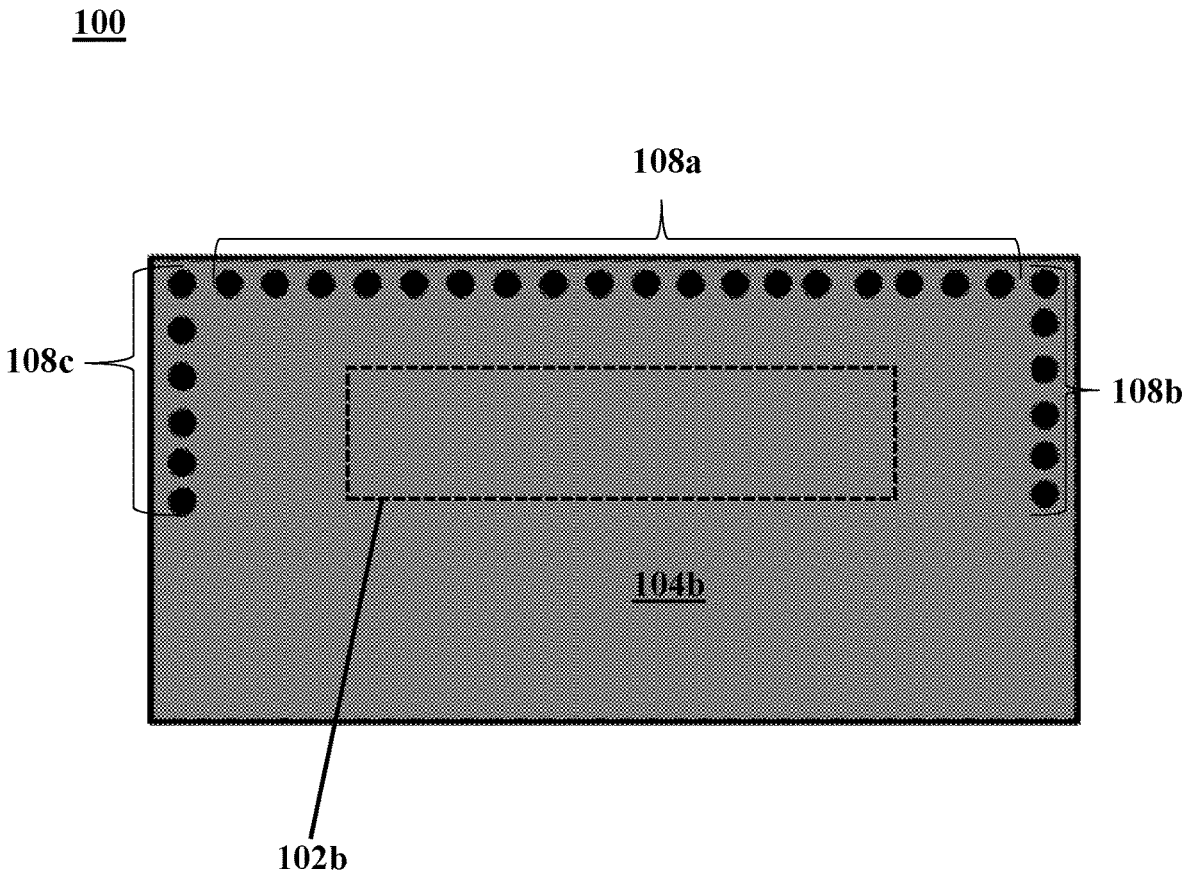
FIG. 1C illustrates a schematic rear view of a wideband SIW slot antenna, consistent with one or more exemplary embodiments of the present disclosure.

FIG. 1A illustrates a schematic perspective view of a wideband SIW slot antenna 100, consistent with one or more exemplary embodiments of the present disclosure. FIG. 1B illustrates a schematic front view of wideband SIW slot antenna 100, consistent with one or more exemplary embodiments of the present disclosure. FIG. 1C illustrates a schematic rear view of wideband SIW slot antenna 100, consistent with one or more exemplary embodiments of the present disclosure.

Referring to FIGS. 1A-1C, in an exemplary embodiment, wideband SIW slot antenna 100 may include an SIW structure 101 and a transverse radiating slot 106 that may be disposed on SIW structure 101. In an exemplary embodiment, SIW structure 101 may include a substrate 102 with a first surface 120 and a second surface 122, a first conductive layer 104*a* that may be disposed on first surface 120, a second conductive layer 104*b* that may be disposed on second surface 122, and waveguide sidewalls 108*a-c* that may include spaced-apart metal-lined vias, where each via may pass through substrate 102. In an exemplary embodiment, wideband SIW slot antenna 100 may further include a microstrip feed line 110 formed on first surface 120*a* that may be matched with SIW structure 101 by a tapered transition 111.

In an exemplary embodiment, substrate 102 may include a first substrate portion 102*a* with a first permittivity and a second substrate portion 102*b* with a second permittivity. In an exemplary embodiment, second permittivity may be less than unity and second substrate portion 102*b* may be placed immediately beneath radiating slot 106 spaced-apart from waveguide sidewalls 108 and microstrip feed line 110. In an exemplary embodiment, second substrate portion 102*b* may include a homogenous ENZ metamaterial 126 and second permittivity may be near zero. In an exemplary embodiment first permittivity and second permittivity may be different values of permittivity.

In an exemplary embodiment, first conductive layer 104*a* and second conductive layer 104*b* may be plated onto first surface 120 and second surface 122 of substrate 102, respectively. First conductive layer 104*a* and second conductive layer 104*b* may function as finite ground planes of wideband SIW slot antenna 100.

In an exemplary embodiment, waveguide sidewalls 108*a-c* may include equally spaced-apart vias or cylindrical holes traversing through first substrate portion 102*a* and interior walls of these vias or cylindrical holes may be lined with a conductive material. In an exemplary embodiment, each via or cylindrical hole may be perpendicular to planes of first conductive layer 104*a* and second conductive layer 104*b*.

In an exemplary embodiment, microstrip feed line 110 may be formed by etching first conductive layer 104*a*. Microstrip feed line 110 may be matched to SIW structure 101 by a simple tapered transition.

Figure 2A:
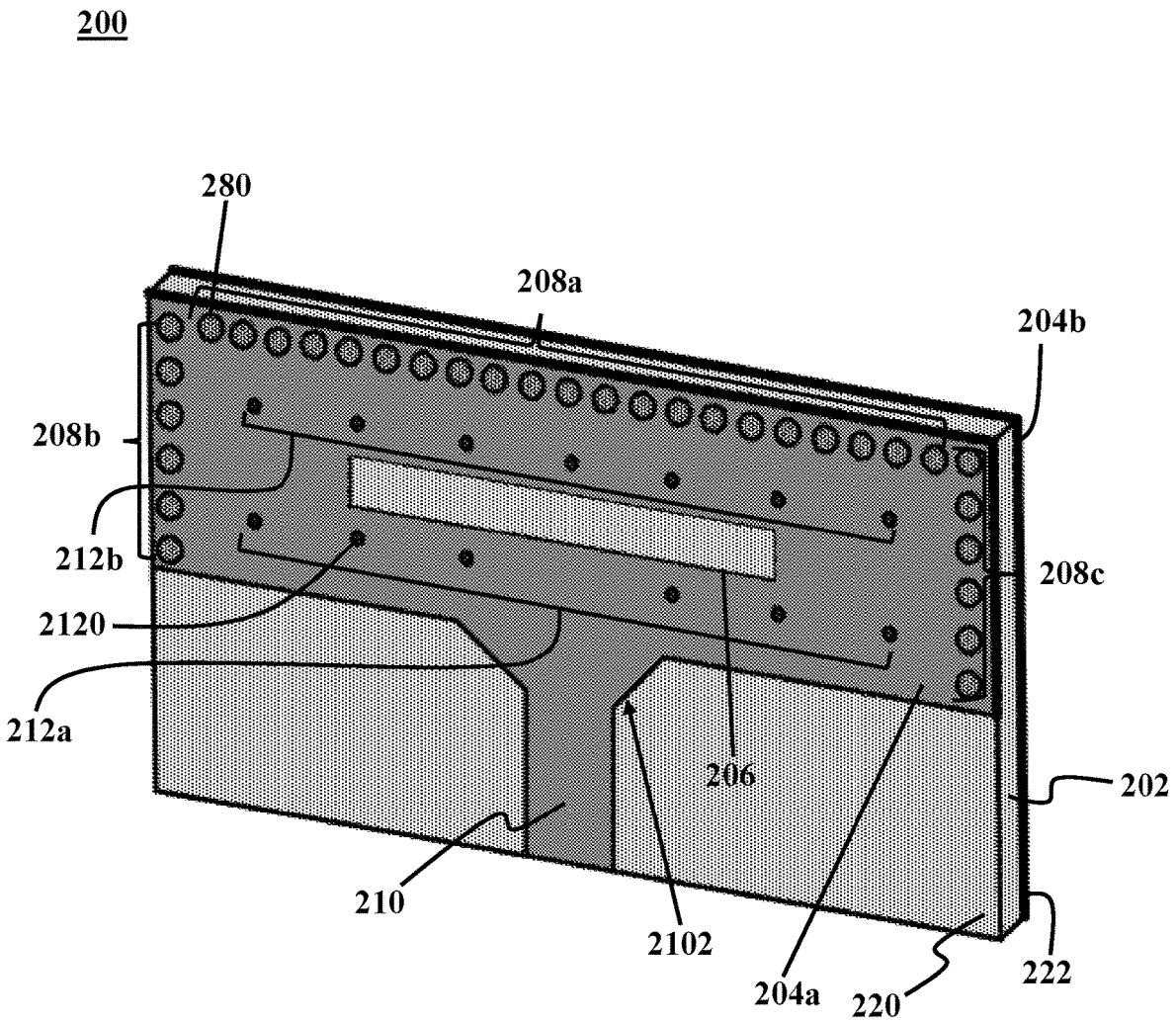
FIG. 2A illustrates a schematic perspective view of a wideband SIW slot antenna, consistent with one or more exemplary embodiments of the present disclosure.
Figure 2B:
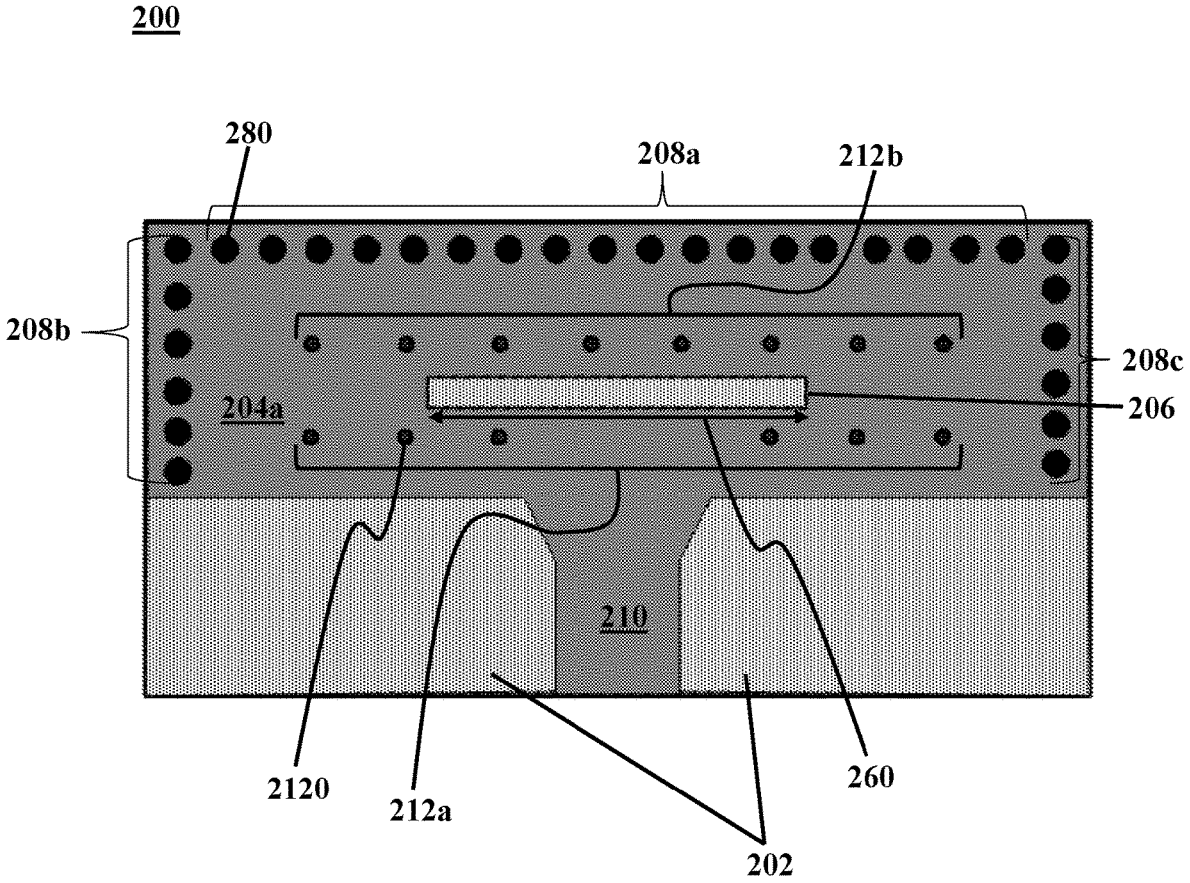
FIG. 2B illustrates a schematic front view of a wideband SIW slot antenna, consistent with one or more exemplary embodiments of the present disclosure.
Figure 2C:
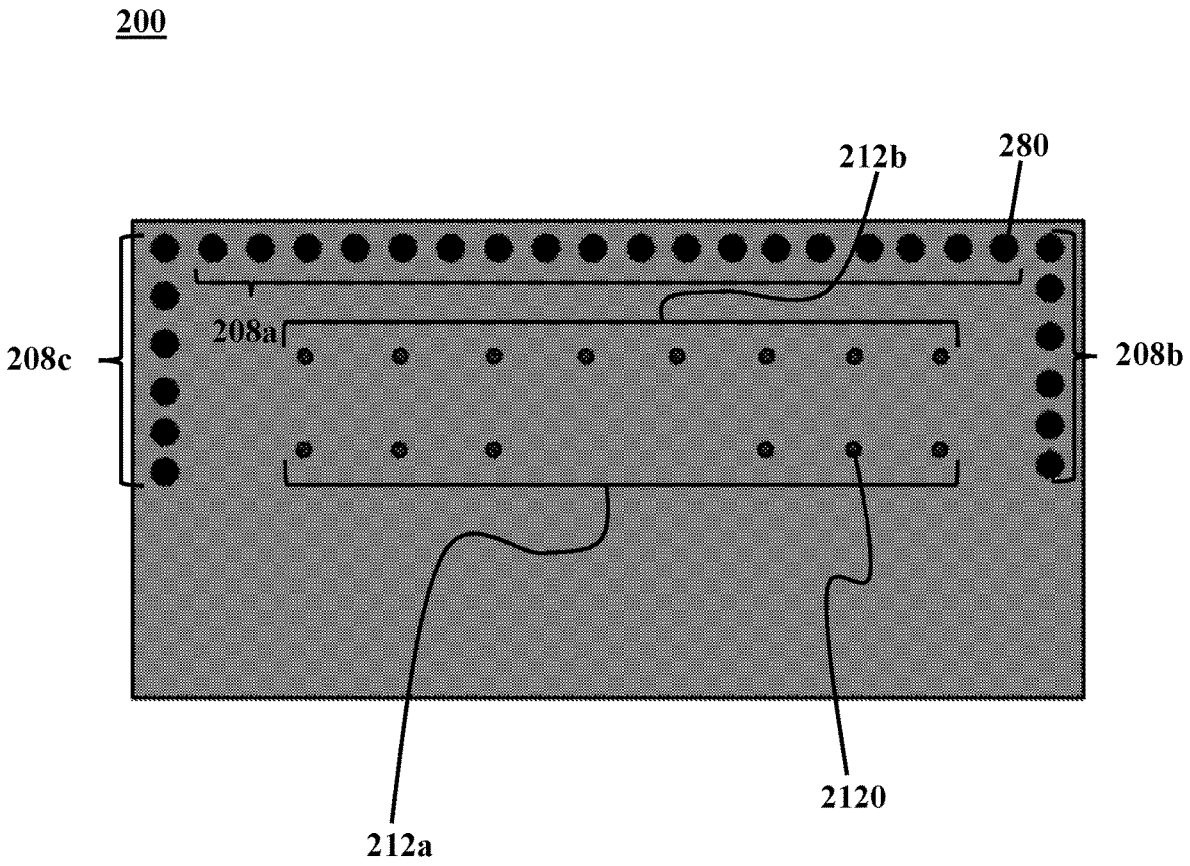
FIG. 2C illustrates a schematic rear view of a wideband SIW slot antenna, consistent with one or more exemplary embodiments of the present disclosure.

FIG. 2A illustrates a schematic perspective view of a wideband SIW slot antenna 200, consistent with one or more exemplary embodiments of the present disclosure. FIG. 2B illustrates a schematic front view of wideband SIW slot antenna 200, consistent with one or more exemplary embodiments of the present disclosure. FIG. 2C illustrates a schematic rear view of wideband SIW slot antenna 200, consistent with one or more exemplary embodiments of the present disclosure.

Referring to FIGS. 2A-2C, in an exemplary embodiment, wideband SIW slot antenna 200 may include a substrate 202 with a first surface 220 and a second surface 222, a first conductive layer 204*a* similar to first conductive layer 104*a* that may be disposed on first surface 220, a second conductive layer 204*b* similar to second conductive layer 104*a* that may be disposed on second surface 222, a transverse radiating slot 206 similar to transverse radiating slot 106 that may be disposed on first conductive layer 204*a*, waveguide sidewalls 208*a-c* similar to waveguide side walls 108*a-c* that may include spaced-apart metal-lined vias traversing through substrate 202, and a microstrip feed line 210 similar to microstrip feed line 110 that may be formed on first surface 220*a*.

In an exemplary embodiment, wideband SIW slot antenna 200 may further include arrays of thin conductive wires inserted into substrate 202 that may be perpendicular to a plane of transverse radiating slot 206. In an exemplary embodiment, arrays of thin conductive wires may include a first array of conductive wires 212*a* disposed along and spaced apart from a first side of the transverse radiating slot 206. In an exemplary embodiment, each wire in first array of conductive wires 212*a* may be inserted into substrate 202 perpendicular to a plane of the transverse radiating slot 206. First array of conductive wires 212*a* may connect first conductive layer 204*a* and second conductive layer 204*b*. In an exemplary embodiment, arrays of thin conductive wires may further include a second array of conductive wires 212*b* disposed along and spaced apart from an opposing second side of the transverse slot. Each wire in second array of conductive wires 212*b* inserted into substrate 202 perpendicular to a plane of transverse radiating slot 206. Second array of conductive wires 212*b* may connect first conductive layer 204*a* and second conductive layer 204*b*.

In exemplary embodiments, first and second arrays of conductive wires 212*a-b* that may be inserted into substrate 202 on either side of transverse radiating slot 206 may allow for realization of a homogeneous ENZ metamaterial segment with a permittivity near zero immediately beneath transverse radiating slot 206, similar to second substrate portion 102*b*. In an exemplary embodiment, each wire in first and second arrays of conductive wires 212*a-b* may be oriented with respect to wave polarization such that each wire may be perpendicular to magnetic field lines beneath transverse radiating slot 206. In other words, each wire may be oriented perpendicular to first conductive layer 204*a* and second conductive layer 204*b*. In exemplary embodiments, such configuration of first and second arrays of conductive wires 212-*b* may allow for realization of an ENZ metamaterial in the structure of wideband SIW slot antenna 200.

Figure 3:
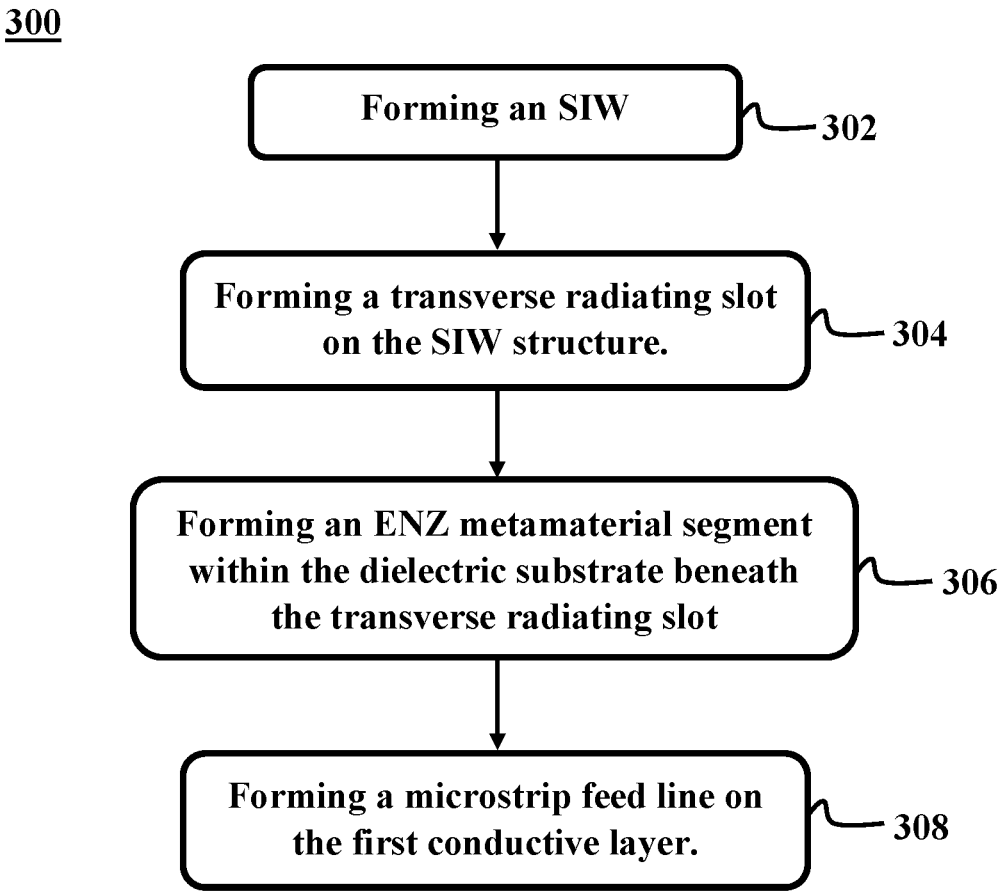
FIG. 3 illustrates a method for fabricating a wideband SIW slot antenna, consistent with an exemplary embodiment of the present disclosure.

FIG. 3 illustrates a method 300 for fabricating a wideband SIW slot antenna, consistent with an exemplary embodiment of the present disclosure. In an exemplary embodiment, method 300 may be utilized for fabricating a wideband SIW slot antenna similar to wideband SIW slot antenna 200.

In an exemplary embodiment, method 300 may include a step 302 of forming an SIW structure, a step 304 of forming a transverse radiating slot on the SIW structure, a step 306 of forming an ENZ metamaterial segment within a dielectric substrate of the SIW structure beneath the transverse radiating slot, and a step 308 of forming a microstrip feed line on the first conductive layer.

In an exemplary embodiment, step 302 of forming the SIW structure may include plating a first surface of a dielectric substrate with a first conductive layer, for example, plating first surface 220 of substrate 202 with first conductive layer 204*a*. Step 302 of forming the SIW structure may further include plaing a second surface of a dielectric substrate with a second conductive layer, for example, plating second surface 222 of substrate 202 with second conductive layer 204*b*. Step 302 of forming the SIW structure may further include forming waveguide sidewalls by forming a number of spaced-apart metal-lined vias through the first conductive layer, the dielectric substrate, and the second conductive layer, for example forming sidewalls 208 by forming a number of spaced-apart metal-lined vias through first conductive layer 204*a*, substrate 202, and second conductive layer 204*b*. In an exemplary embodiment, each metal-lined via of the spaced-apart metal-lined vias may include a cylindrical hole through the first conductive layer, the dielectric substrate, and the second conductive layer. For example, metal-lined via 280 may be a cylindrical hole through first conductive layer 204*a*, substrate 202, and second conductive layer 204*b*. In an exemplary embodiment, each metal-lined via of the spaced-apart metal-lined vias may be perpendicular to planes of the first conductive layer and the second conductive layer.

In an exemplary embodiment, step 304 of forming a transverse radiating slot on the SIW structure may include forming the transverse radiating slot on the first conductive layer by etching or cutting the first conductive layer such that a portion of the substrate immediately beneath the transverse radiating slot may be exposed. In an exemplary embodiment, forming the transverse radiating slot on the SIW structure may include forming a rectangular transverse radiating slot on the first conductive layer such that the rectangular transverse radiating slot may be symmetrically disposed in a center of the SIW structure.

In an exemplary embodiment, step 306 of forming an ENZ metamaterial segment within the dielectric substrate beneath the transverse radiating slot may include inserting arrays of conductive wires into the dielectric substrate on either sides of the transverse radiating slot. For example, first array of conductive wires 212*a* may be inserted into substrate 202 along a length 260 of radiating slot 206 on a first side of radiating slot 206 and second array of conductive wires 212*b* may be inserted into substrate 202 along a length 260 of radiating slot 206 on a second opposing side of radiating slot 206.

In an exemplary embodiment, each conductive wire of the arrays of conductive wires, may be perpendicular to planes of the first conductive layer and the second conductive layer. For example, each conductive wire of first and second arrays of conductive wires 212*a-b*, such as wire 2120 may be inserted into substrate 202 perpendicular to planes of first conductive layer 204*a* and second conductive layer 204*b*. In an exemplary embodiment, each conductive wire may connect the first conductive layer to the second conductive layer. For example, each conductive wire of first and second arrays of conductive wires 212*a-b*, such as wire 2120 may connect first conductive layer 204*a* and second conductive layer 204*b*. In an exemplary embodiment, the arrays of conductive wires may be inserted into the substrate such that the arrays of conductive wires may be spaced-apart from the waveguide sidewalls and the microstrip feedline. For example, first array of conductive wires 212*a* may be an array of equally spaced-apart conductive wires spaced apart from sidewalls 208 and microstrip feedline 210, and second array of conductive wires 212*b* may be an array of equally spaced-apart conductive wires spaced apart from sidewalls 208 and microstrip feedline 210.

In an exemplary embodiment, step 308 of forming a microstrip feed line on the first conductive layer may include etching the microstrip feed line on the first conductive layer such that the microstrip feedline may be matched to the SIW structure by a tapered transition. For example, microstrip feedline 210 may be formed on first conductive layer 204*a* and may be matched to the SIW structure by a tapered transition 2102.

Example 1

Figure 4:
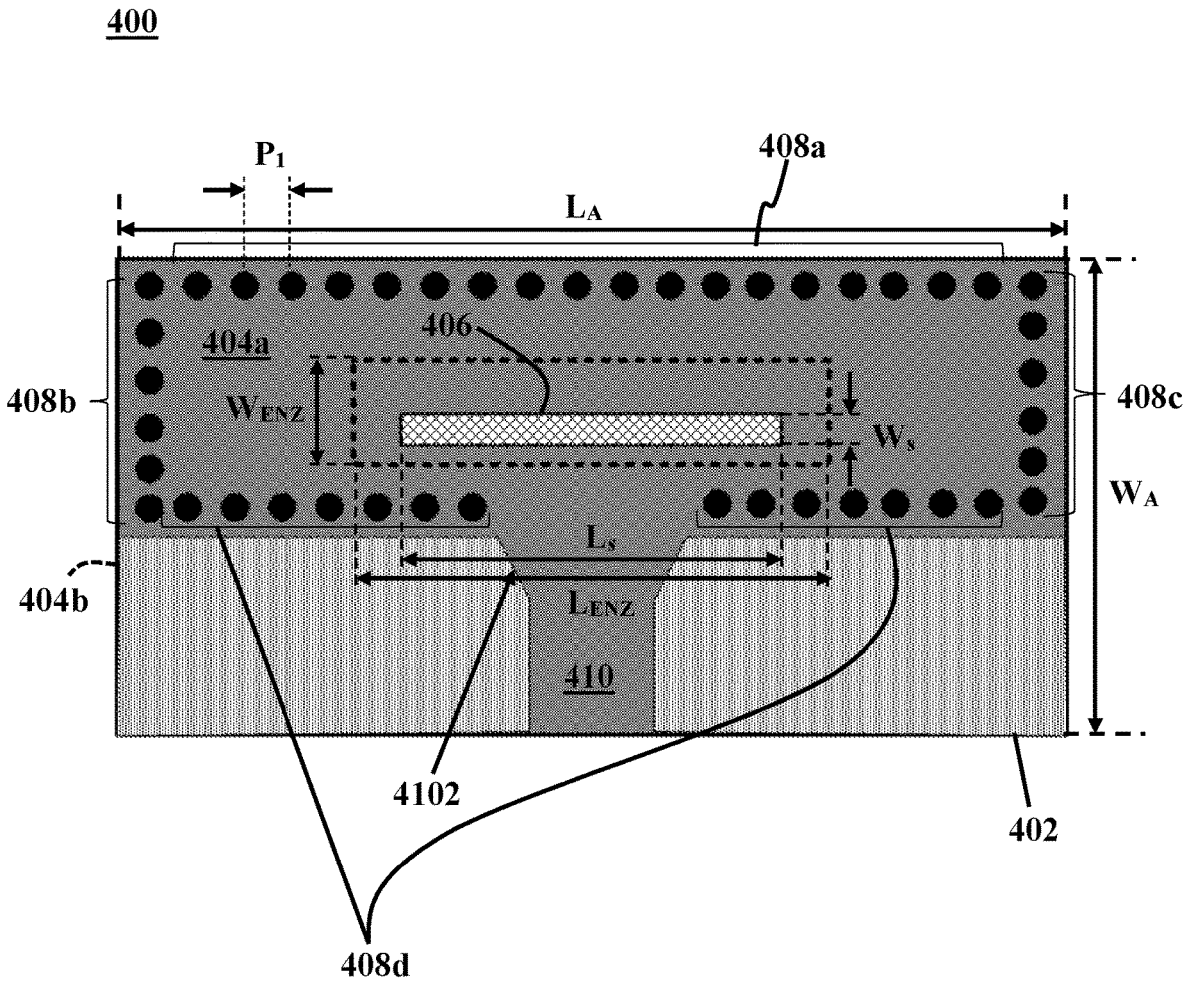
FIG. 4 illustrates an exemplary wideband SIW slot antenna, consistent with one or more exemplary embodiments of the present disclosure.

FIG. 4 illustrates an exemplary wideband SIW slot antenna 400, consistent with one or more exemplary embodiments of the present disclosure. In an exemplary embodiment, wideband SIW slot antenna 400 may be similar to wideband SIW slot antenna 100 and may be fabricated by method 300.

In an exemplary embodiment, wideband SIW slot antenna 400 may include a substrate 402 similar to substrate 102 that may be plated on both sides with a first conductive layer 404*a* and a second conductive layer 404*b* similar to first and second conductive layers 104*a* and 104*b*, a transverse radiating slot 406 similar to transverse radiating slot 106 that may be disposed on first conductive layer 404*a*, waveguide sidewalls 408*a-d* similar to waveguide sidewalls 108*a-c* that may include spaced-apart metal-lined vias traversing through substrate 402, and a microstrip feed line 410 with an impedance that may be designed for 50Ω. A tapered transition 4102 similar to tapered transition 2102 of FIG. 2A may be used to match microstrip feed line 410 to the SIW structure.

In an exemplary embodiment, substrate 402 may include a first substrate portion 402*a* similar to first substrate portion 102*a* with a first permittivity and a second substrate portion 402*b* similar to second substrate portion 102*b* with a second permittivity. In an exemplary embodiment, second permittivity may be less than unity and second substrate portion 402*b* may be placed immediately beneath radiating slot 406 spaced-apart from waveguide sidewalls 408 and microstrip feed line 410. In an exemplary embodiment, second substrate portion 402*b* may include a homogenous ENZ metamaterial 426 that may replace a portion of substrate 402 as a guest substrate while first substrate portion 402*a* functions as a host substrate. In an exemplary embodiment, first substrate portion 402*a* may be a dielectric material such as RT5870 with the first permittivity equal to approximately 2.33.

In an exemplary embodiment, substrate 402 may have a length $L_A$ of about 25 mm, a width $W_A$ of about 12.5 mm, and a thickness of about 0.787 mm. Transverse radiating slot 406 may have a length $L_s$ of about 10 mm and a width $W_s$ of about 0.5 mm. Transverse radiating slot 406 may be symmetrically disposed on the SIW structure and may be spaced-apart from microstrip feed line 410 by a distance of about 2.1 mm. In an exemplary embodiment, second substrate portion 402*b* may have a length $L_{ENZ}$ of about 16 mm, a width $W_{ENZ}$ of about 3.5 mm, and a thickness that may be equal to the thickness of substrate 402.

In an exemplary embodiment, waveguide sidewalls 408*a-d* may include equally spaced-apart metal-lined vias with an equal center-to-center spacing $P_1$ of 1.2 mm between two adjacent vias. Each metal-lined via may be a cylindrical hole perpendicular to a plane of substrate 402 with a radius of 0.3 mm and a height equal to a thickness of substrate 402, which may be equal to 0.787 mm.

In an exemplary embodiment, wideband SIW slot antenna 400 may be simulated with different values for the second permittivity of second substrate portion 402*b*. Four different values of 0.2, 0.4, 0.7, and 1 were used for the second permittivity to simulate the performance of wideband SIW slot antenna 400.

Figure 5A:
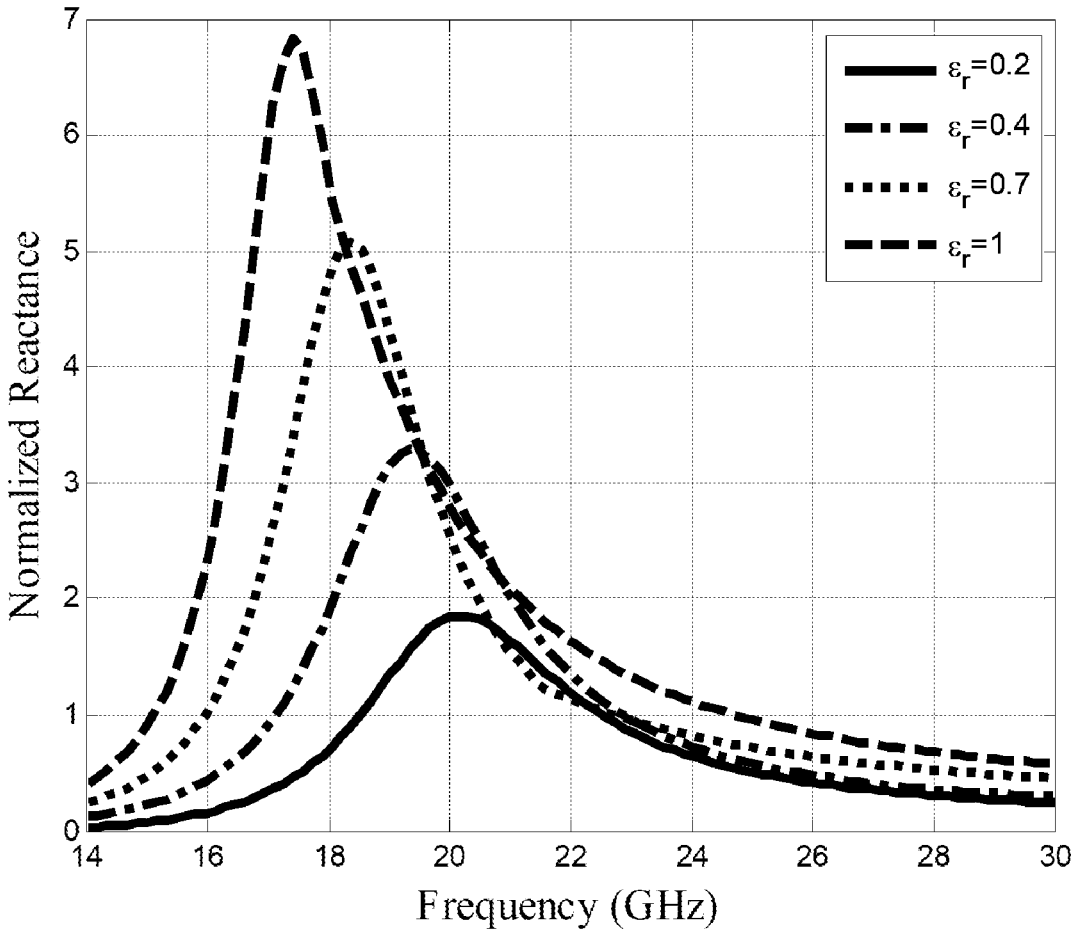
FIG. 5A illustrates real parts of slot-normalized impedances in an exemplary wideband SIW slot antenna with different values for permittivities at different frequencies, consistent with one or more exemplary embodiments of the present disclosure.
Figure 5B:
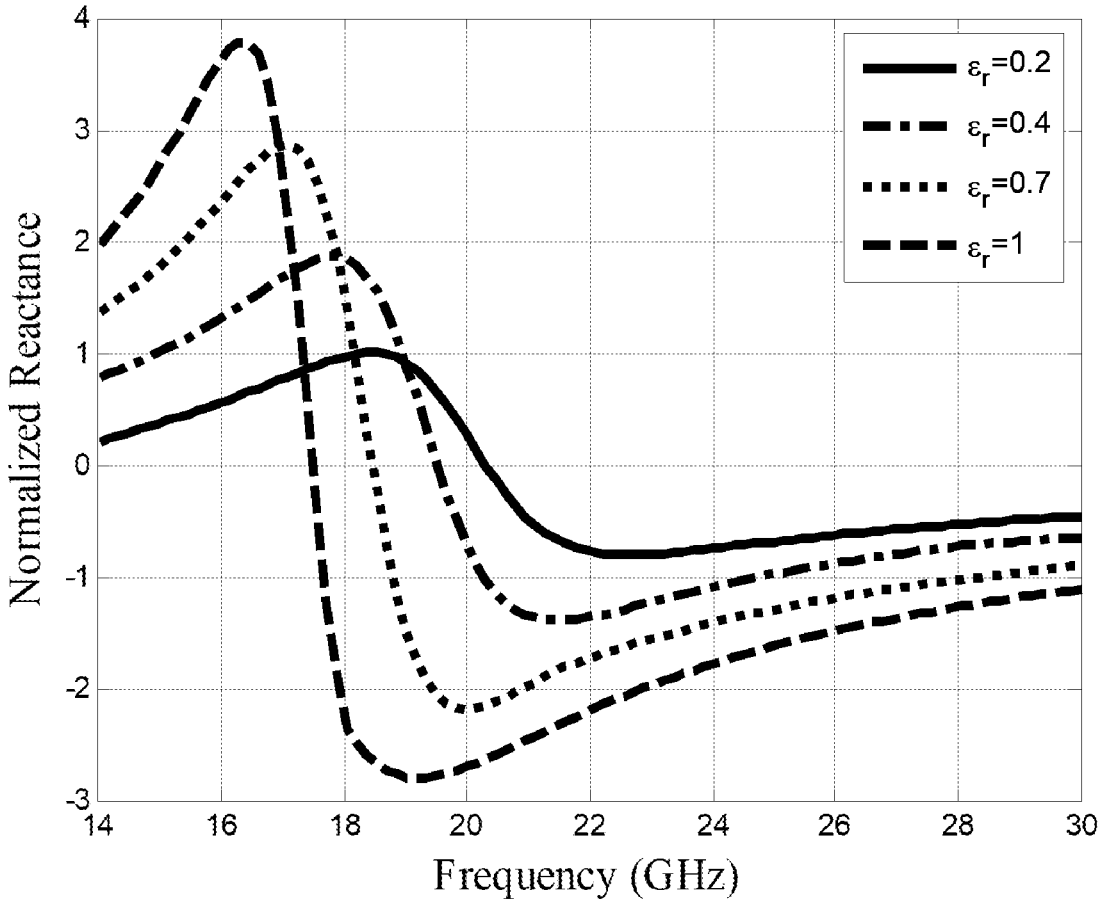
FIG. 5B illustrates imaginary parts of slot-normalized impedances in an exemplary wideband SIW slot antenna with different values for permittivities at different frequencies, consistent with one or more exemplary embodiments of the present disclosure.

FIG. 5A illustrates real parts of slot-normalized impedances in exemplary wideband SIW slot antenna 400 with different values for permittivities at different frequencies, consistent with one or more exemplary embodiments of the present disclosure. FIG. 5B illustrates imaginary parts of slot-normalized impedances in exemplary wideband SIW slot antenna 400 with different values for permittivities at different frequencies, consistent with one or more exemplary embodiments of the present disclosure. As evident in FIGS. 5A and 5B, the reactance of the input impedance decreases by decreasing the second permittivity.

Example 2

Figure 6A:
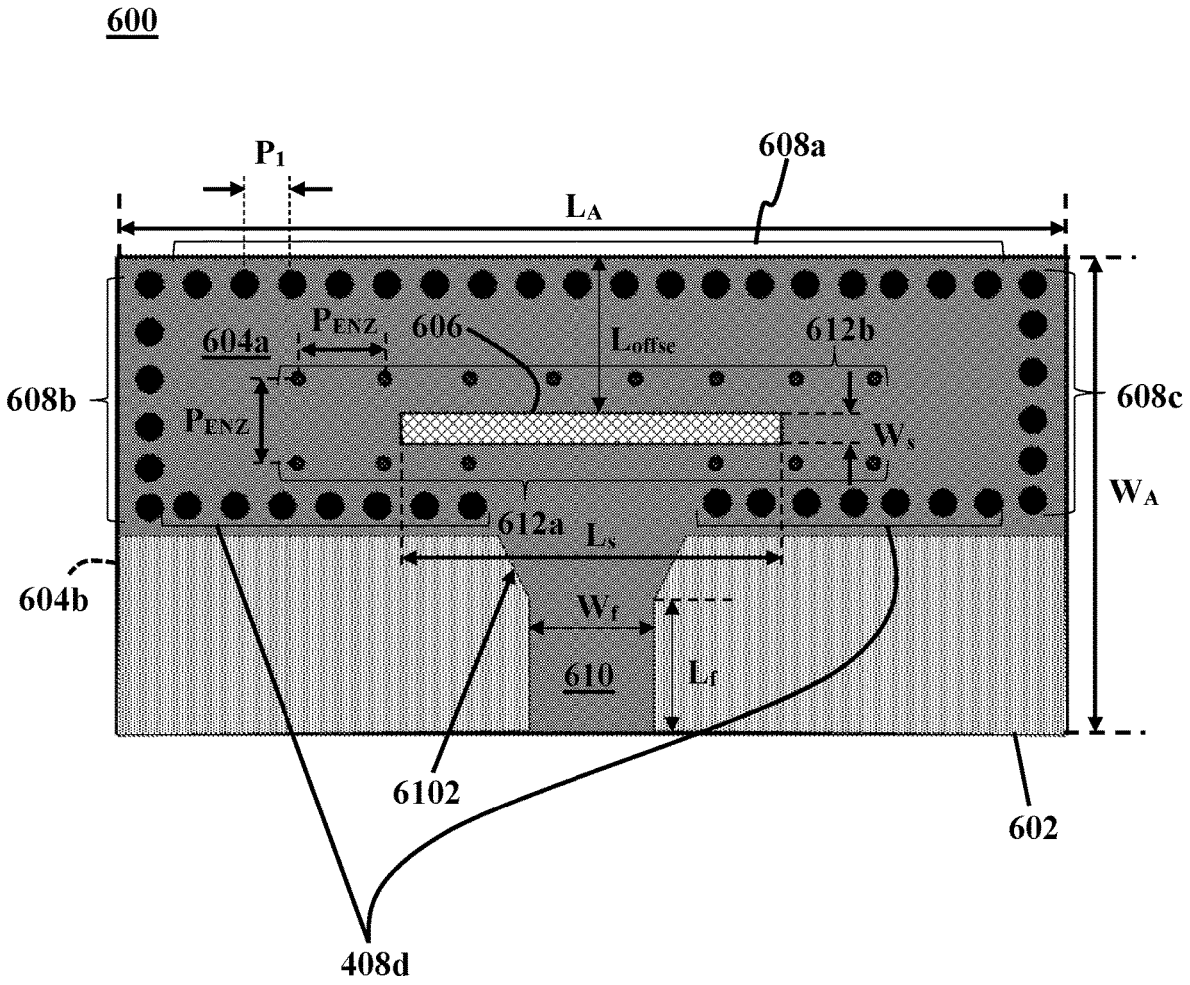
FIG. 6A illustrates an exemplary wideband SIW slot antenna, consistent with one or more exemplary embodiments of the present disclosure.

FIG. 6A illustrates an exemplary wideband SIW slot antenna 600, consistent with one or more exemplary embodiments of the present disclosure. In an exemplary embodiment, wideband SIW slot antenna 600 may be similar to wideband SIW slot antenna 200 and may be fabricated by method 300.

In an exemplary embodiment, wideband SIW slot antenna 600 may include a substrate 602 similar to substrate 202 that may be plated on both sides with a first conductive layer 604*a* and a second conductive layer 604*b* similar to first and second conductive layers 204*a* and 204*b*, a transverse radiating slot 606 similar to transverse radiating slot 206 that may be disposed on first conductive layer 604*a*, waveguide sidewalls 608*a-d* similar to waveguide sidewalls 208 that may include spaced-apart metal-lined vias traversing through substrate 602, and a microstrip feed line 610 with an impedance that may be designed for 50Ω. A tapered transition 6102 similar to tapered transition 2102 of FIG. 2A may be used to match microstrip feed line 610 to the SIW structure. In an exemplary embodiment, microstrip feed line 610 may have a length $L_f$ of about 3.5 mm and a width $W_r$ of about 2.35 mm.

In an exemplary embodiment, wideband SIW slot antenna 600 may further include arrays of thin conductive wires inserted into substrate 602 that may be perpendicular to a plane of transverse radiating slot 606. In an exemplary embodiment, arrays of thin conductive wires may include a first array of conductive wires 612*a* similar to first array of conductive wires 212*a* disposed along and spaced apart from a first side 662*a* of the transverse radiating slot 606. In an exemplary embodiment, each wire in first array of conductive wires 612*a* may be inserted into substrate 602 perpendicular to a plane of the transverse radiating slot 606. In an exemplary embodiment, arrays of thin conductive wires may further include a second array of conductive wires 612*b* similar to second array of conductive wires 212*b* disposed along and spaced apart from an opposing second side of the transverse slot. Each wire in second array of conductive wires 612*b* inserted into substrate 602 perpendicular to a plane of transverse radiating slot 606.

In an exemplary embodiment, each conductive wire in first and second arrays of conductive wires 612*a-b* may have a diameter of 0.3 mm. Conductive wires in each array of conductive wires 612*a-b* may be equally spaced apart by a pitch $P_{ENZ}$ of about 2.83 mm. First array of conductive wires 612*a* and second array of conductive wires 612*b* may be spaced apart from each other by $P_{ENZ}$.

In an exemplary embodiment, transverse radiating slot 606 may symmetrically be disposed in a center of the SIW structure with an offset $L_{offset}$ of approximately 3.8 mm from an upper edge of wideband SIW slot antenna 600.

In an exemplary embodiment, substrate 602 may have a length $L_A$ of about 25 mm, a width $W_A$ of about 12.5 mm, and a thickness of about 0.787 mm. Transverse radiating slot 606 may have a length $L_s$ of about 10 mm and a width $W_s$ of about 0.5 mm. Transverse radiating slot 606 may be disposed on first conductive layer 604A and may be spaced-apart from microstrip feed line 610 by a distance of about 2.1 mm.

In an exemplary embodiment, waveguide sidewalls 608*a-d* may include equally spaced-apart metal-lined vias with an equal center-to-center spacing $P_1$ of 1.2 mm between two adjacent vias. Each metal-lined via may be a cylindrical hole perpendicular to a plane of substrate 602 with a radius of 0.6 mm and a height equal to a thickness of substrate 602, which may be equal to 0.787 mm.

The ENZ materials can be found in visible and infrared frequency ranges. However, in the microwave region, ENZ is implemented using periodic structures, known as a metamaterials. The arrays of thin wires such as first and second arrays of conductive wires 612*a-b* are an example of these periodic structures that may provide an acceptable bandwidth. In an exemplary embodiment, each wire in first and second arrays of conductive wires 612*a-b* my be parallel to the electric field lines applied to wideband SIW slot antenna 600 while the magnetic field and wave propagation direction are orthogonal to each wire in first and second arrays of conductive wires 612*a-b*.

In an exemplary embodiment, a plasma frequency of first and second arrays of conductive wires 612*a-b* may be related to sizes of first and second arrays of conductive wires 612*a-b* and radius of each conductive wire in first and second arrays of conductive wires 612*a-b* as follows:

$$\omega_p^2 = \frac{2\pi}{\mu_0 \varepsilon_0 a^2 [\ln\{a/2\pi r\} + 0.5275]} \quad \text{Equation (1)}$$

In Equation (1) above, $\mu_0$ and $\varepsilon_0$ denote permeability and permittivity of the substrate, respectively, a denoted the size of a single wire cell in the array of conductive wires, and r denoted the radius of each single wire in the array.

Figure 6B:
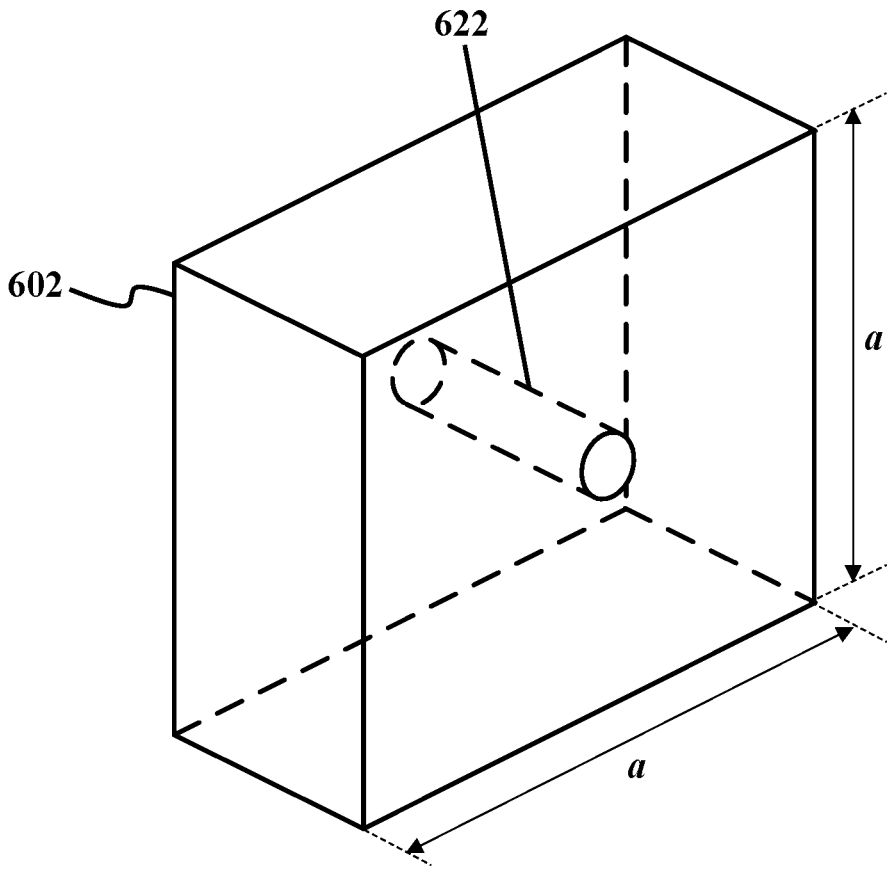
FIG. 6B illustrates a schematic perspective view of a single wire cell, consistent with one or more exemplary embodiments of the present disclosure.

In this example, the chosen plasma frequency is 19 GHz and a minimum radius of 0.15 mm is used for wires. Equation (1) may be used with these values for the radius and the plasma frequency in order to obtain a proper size for each single wire cell. FIG. 6B illustrates a schematic perspective view of each single wire cell 620, consistent with one or more exemplary embodiments of the present disclosure. In an exemplary embodiment, each single wire cell 620 may include a single conductive wire 622 inserted into substrate 602. Substrate 602 may be Rogers RT5870 with a permittivity of 2.33. Dimension a of the cell is a=2.83 mm while the substrate thickness is 0.787 mm, and the radius of the wire is 0.15 mm.

Figure 7A:
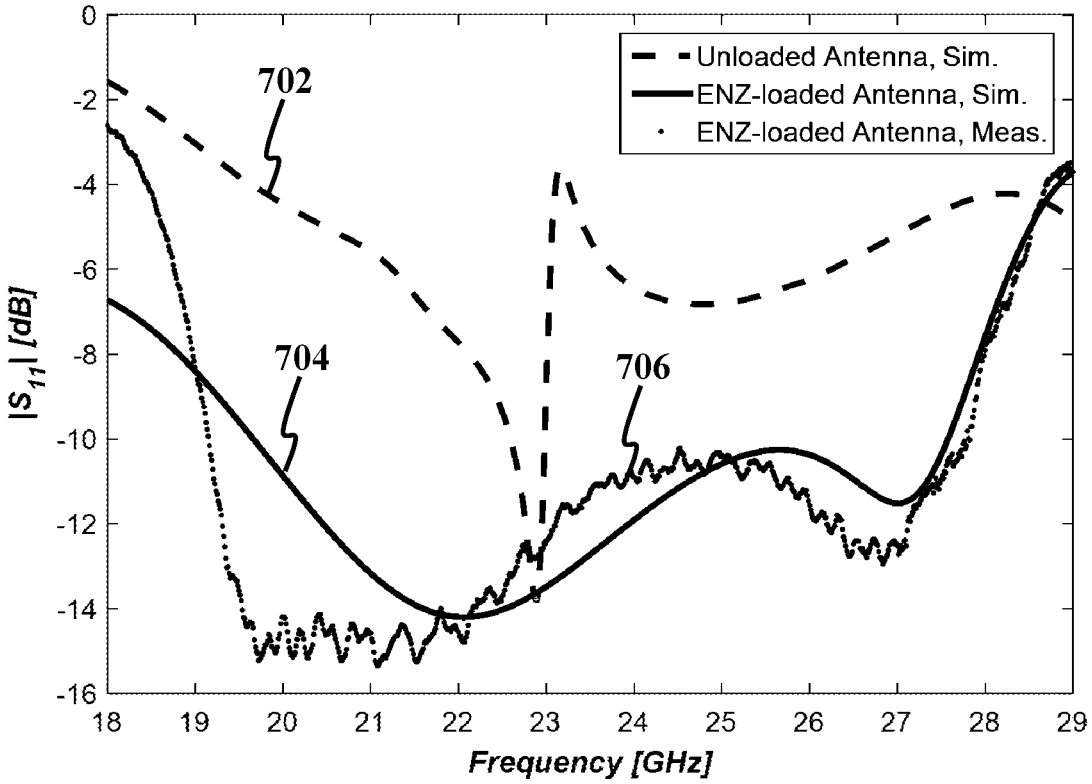
FIG. 7A illustrates variations of s-parameter of an unloaded SIW slot antenna, a simulated wideband SIW slot antenna, and a wideband SIW slot antenna at different frequencies, consistent with one or more exemplary embodiments of the present disclosure.

The reflection coefficient of wideband SIW slot antenna 600 is measured using Agilent N5230A network analyzer. FIG. 7A illustrates variations of s-parameter of an unloaded SIW slot antenna (curve 702), a simulated wideband SIW slot antenna (curve 704), and wideband SIW slot antenna 600 (curve 706) at different frequencies, consistent with one or more exemplary embodiments of the present disclosure. As evident from FIG. 7A, a good agreement exists between measured (curve 706) and simulated (curve 704) values for the reflection coefficient. Wideband SIW slot antenna 600 provides a wideband impedance bandwidth (from 19.1 to 27.8 GHz), which is substantially higher than the unloaded slot antenna (22.6-23 GHz, 1.75%). In this example, the unloaded antenna has a similar structure to wideband SIW slot antenna 600 but without the wire arrays.

Generally, the size of the radiating element increases by reducing the permittivity, but the size of the wideband SIW slot antenna 600 is mainly defined by the SIW structure rather than radiating slot 606. As a result, an ENZ-loaded SIW slot antenna, such as wideband SIW slot antenna 600 provides compact dimensions along with higher bandwidths compared to unloaded SIW slot antennas.

Figure 7B:
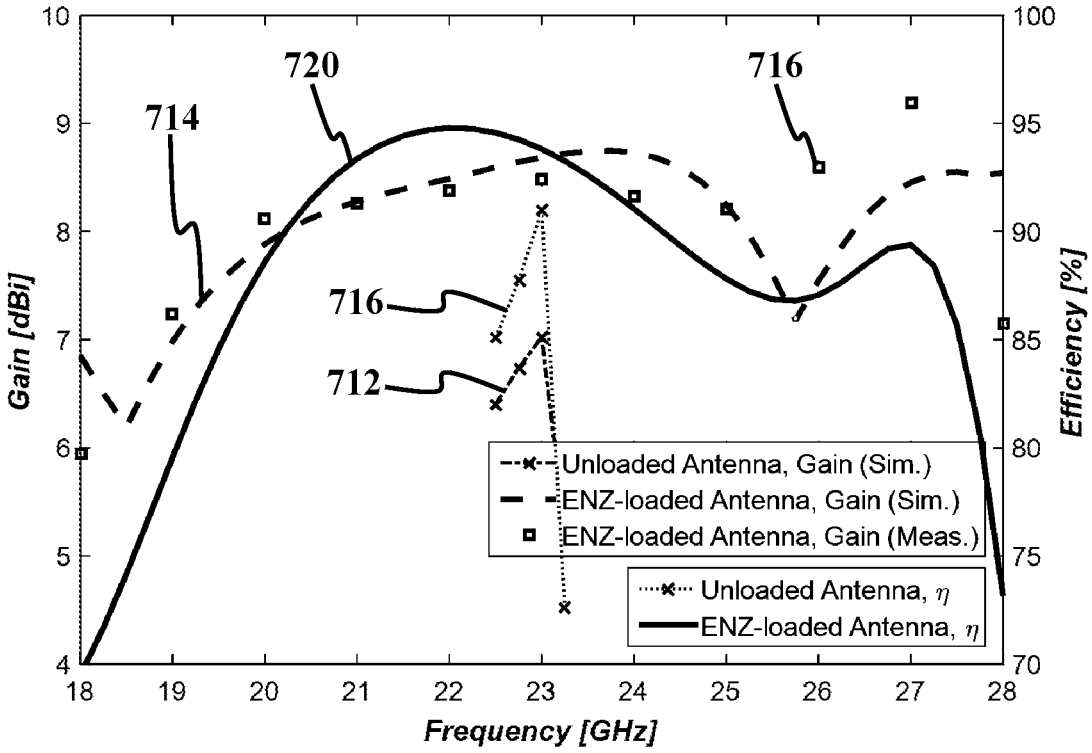
FIG. 7B illustrates variations of maximum gain for an unloaded SIW slot antenna, a simulated wideband SIW slot antenna, and a wideband SIW slot antenna at different frequencies and maximum efficiency of the antenna for unloaded SIW slot antenna and wideband SIW slot antenna, consistent with one or more exemplary embodiments of the present disclosure.

FIG. 7B illustrates variations of maximum gain for an unloaded SIW slot antenna (curve 712), a simulated wideband SIW slot antenna (curve 714), and wideband SIW slot antenna 600 (curve 716) at different frequencies and maximum efficiency of the antenna for unloaded SIW slot antenna (718) and wideband SIW slot antenna 600 (720), consistent with one or more exemplary embodiments of the present disclosure. It is evident that the gain and efficiency of wideband SIW slot antenna 600 increased in comparison with the conventional unloaded slot antenna. As evident in FIG. 7B, the efficiency of wideband SIW slot antenna 600 is above 80% while the gain is more than 7 dBi over the bandwidth.

Examples 1 and 2 above show that the impedance bandwidth of an SIW slot antenna may be improved by loading the SIW structure with a metamaterial with a permittivity less than unity and near zero. The metamaterial may be loaded immediately beneath the radiating slot of the SIW slot antenna and may help enhance the bandwidth, gain, and radiation efficiency of the antenna.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations. This is for purposes of streamlining the disclosure, and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

While various implementations have been described, the description is intended to be exemplary, rather than limiting and it will be apparent to those of ordinary skill in the art that many more implementations and implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in light of the attached claims and their equivalents. Also, various modifications and changes may be made within the scope of the attached claims.

What is claimed is:

1. A substrate integrated waveguide (SIW) slot antenna, comprising:

a substrate comprising a first substrate portion with a first permittivity and a second substrate portion with a second permittivity, the substrate comprising a top surface and a bottom surface;

a first conductive layer disposed on the top surface;

a second conductive layer disposed on the bottom surface;

a transverse slot on the first conducting layer;

waveguide sidewalls comprising a plurality of spaced-apart metal-lined vias traversing the substrate, the metal-lined vias configured to connect the first conductive layer and the second conductive layer; and a microstrip feed line on the first conducting layer, wherein the second substrate portion comprising:

a first portion comprising a dielectric material; and arrays of conductive wires inserted into the first portion on either side of the transverse radiating slot.

2. The SIW slot antenna according to claim 1, wherein the first substrate portion comprising the dielectric material.

3. The SIW slot antenna according to claim 1, wherein the arrays of conductive wires comprising:

a first array of conductive wires disposed along and spaced apart from a first side of the transverse slot, each wire in the first array of conductive wires inserted into the dielectric material perpendicular to a plane of the transverse slot, the first array of conductive wires configured to connect the first conductive layer and the second conductive layer; and a second array of conductive wires disposed along and spaced apart from an opposing second side of the transverse slot, each wire in the second array of conductive wires inserted into the dielectric material perpendicular to a plane of the transverse slot, the second array of conductive wires configured to connect the first conductive layer and the second conductive layer.

4. A method for fabricating a wideband SIW slot antenna, comprising: forming an SIW structure by:

plating a first surface of a dielectric substrate with a first conductive layer; plating a second surface of a dielectric substrate with a second conductive layer; and forming waveguide sidewalls by forming a plurality of spaced-apart metal-lined vias, each metal-lined via comprising a cylindrical hole through the first conductive layer, the dielectric substrate, and the second conductive layer, each metal-lined via perpendicular to planes of the first conductive layer and the second conductive layer; forming a transverse radiating slot on the SIW structure, the transverse radiating slot disposed on the first conductive layer;

forming an epsilone-near-zero (ENZ) metamaterial segment within the dielectric substrate beneath the transverse radiating slot by inserting arrays of conductive wires into the dielectric substrate on either side of the transverse radiating slot; and forming a microstrip feed line on the first conductive layer.

5. The method according to claim 4, wherein forming an ENZ metamaterial segment within the dielectric substrate beneath the transverse radiating slot comprises inserting arrays of conductive wires into the dielectric substrate on either sides of the transverse radiating slot, each conductive wire perpendicular to planes of the first conductive layer and the second conductive layer, each conductive wire traversing through the dielectric substrate connecting the first conductive layer and the second conductive layer.

6. The method according to claim 4, wherein forming a transverse radiating slot on the SIW structure comprises forming a rectangular transverse radiating slot on the first conductive layer, the rectangular transverse radiating slot symmetrically disposed in a center of the SIW structure.

7. The method according to claim 6, wherein forming an ENZ metamaterial segment within the dielectric substrate beneath the transverse radiating slot comprises inserting arrays of conductive wires into the dielectric substrate along a length of the transverse radiating slot on either opposing sides of the transverse radiating slot.

8. The method according to claim 6, wherein forming an ENZ metamaterial segment within the dielectric substrate beneath the transverse radiating slot comprises inserting arrays of conductive wires into the dielectric substrate along a length of the transverse radiating slot on either opposing side of the transverse radiating slot, the arrays of conductive wires spaced apart from the waveguide sidewalls and the microstrip feed line.

9. The method according to claim 4, wherein forming the microstrip feed line on the first conductive layer comprises etching the microstrip feed line on the first conductive layer, the microstrip feed line matched with the SIW structure by a tapered transition.

10. A method for increasing a bandwidth of a slot antenna with a waveguide and a radiating slot disposed on a broad surface of the waveguide, the method comprising loading the waveguide with an epsilon-near-zero (ENZ) metamaterial substrate immediately beneath the slot, the ENZ metamaterial substrate spaced-apart from waveguide sidewalls, the ENZ metamaterial substrate comprising:

a dielectric material; and arrays of conductive wires inserted into the dielectric material on either side of the transverse radiating slot.

11. The method according to claim 10, wherein the waveguide comprises an SIW structure, wherein loading the waveguide with the ENZ metamaterial substrate comprises loading the SIW structure with a substrate comprising at least one segment immediately beneath the radiating slot, the at least one segment comprising the ENZ metamaterial.

12. The method according to claim 10, wherein the waveguide comprises an SIW structure, wherein the radiating slot comprises a rectangular transverse radiating slot, and wherein loading the waveguide with an ENZ metamaterial substrate comprises:

loading the SIW structure with the dielectric substrate; and inserting arrays of conductive wires into the dielectric substrate on either side of the radiating slot, arrays of conductive inserted along a length of the transverse radiating slot perpendicular to a plane of the broad surface of the waveguide.

* * * * *